US011751639B2

(12) United States Patent
Ekstrom et al.

(10) Patent No.: US 11,751,639 B2
(45) Date of Patent: Sep. 12, 2023

(54) SOLE STRUCTURE FOR ARTICLE OF FOOTWEAR

(71) Applicant: NIKE, Inc., Beaverton, OR (US)

(72) Inventors: Mike Ekstrom, Wilsonville, OR (US); Elizabeth Fulkerson, Portland, OR (US); Michael J. Hass, Sherwood, OR (US); John Hlavacs, Portland, OR (US); Ethan Lee, Beaverton, OR (US); Ricardo Salinas, Jr., Hillsboro, OR (US); Darlan Zacharia, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 28 days.

(21) Appl. No.: 17/183,281

(22) Filed: Feb. 23, 2021

(65) Prior Publication Data

US 2021/0259367 A1 Aug. 26, 2021

Related U.S. Application Data

(60) Provisional application No. 62/980,606, filed on Feb. 24, 2020.

(51) Int. Cl.

| | |
|---|---|
| ***A43C 15/16*** | (2006.01) |
| ***A43B 13/22*** | (2006.01) |
| ***A43B 13/12*** | (2006.01) |

(52) U.S. Cl.

CPC ..... *A43C 15/162* (2013.01); *A43B 13/122* (2013.01); *A43B 13/125* (2013.01); *A43B 13/223* (2013.01)

(58) Field of Classification Search

CPC ..... A43B 5/001; A43B 13/223

See application file for complete search history.

(56) References Cited

U.S. PATENT DOCUMENTS

| | | | |
|---|---|---|---|
| 1,972,249 | A | 9/1934 | Schneider |
| 2,095,095 | A | 10/1937 | Howard |
| 3,082,549 | A | 3/1963 | Dolceamore |
| 3,463,165 | A | 8/1969 | Goodman |
| 4,067,123 | A | 1/1978 | Minihane |
| 4,194,310 | A | 3/1980 | Bowerman |

(Continued)

FOREIGN PATENT DOCUMENTS

| | | | |
|---|---|---|---|
| DE | 3127793 | C1 * | 1/1983 |
| EP | E P-0410163 | A3 * | 3/1992 |

OTHER PUBLICATIONS

International Search Report and Written Opinion in PCT/US2021/019343 dated May 14, 2021 (15 pages).

*Primary Examiner* — Megan E Lynch

(74) *Attorney, Agent, or Firm* — Bookoff McAndrews, PLLC

(57) ABSTRACT

An outsole for an article of footwear includes a plantar surface and a peripheral surface surrounding the plantar surface. The outsole for an article of footwear also includes an annular cleat set including a first plurality of traction elements arranged in series about a central axis on the plantar surface. The outsole for an article of footwear further includes one or more radial cleat sets each including a second plurality of the traction elements aligned along a respective radial axis intersecting the central axis. At least one of the second plurality of the traction elements includes a peripheral cleat formed on the peripheral surface.

17 Claims, 11 Drawing Sheets

(56) References Cited

U.S. PATENT DOCUMENTS 4,402,145 A 9/1983 Dassler
4,550,510 A * 11/1985 Stubblefield ..... A43B 13/181 36/114
4,586,274 A * 5/1986 Blair ..... A43B 13/223 36/114
4,670,997 A * 6/1987 Beekman ..... A43B 13/223 36/114
4,689,901 A * 9/1987 Ihlenburg ..... A43B 3/0042 36/114
D295,231 S * 4/1988 Heyes ..... D2/962
5,201,126 A * 4/1993 Tanel ..... A43B 3/0042 36/134
D376,683 S 12/1996 Gaudio et al.
5,782,017 A * 7/1998 Ortscheid ..... A43C 15/162 36/34 A
D416,673 S 11/1999 Menke
6,016,613 A * 1/2000 Campbell ..... A43B 5/001 D2/906
6,041,526 A * 3/2000 Collins ..... A43C 15/164 36/134
6,101,746 A * 8/2000 Evans ..... A43C 15/162 36/134
6,289,611 B1 * 9/2001 Patterson ..... A43C 15/16 D2/906
6,793,996 B1 * 9/2004 Umezawa ..... A43C 15/167 36/129
6,973,745 B2 12/2005 Mills et al.
D579,185 S 10/2008 Mariman et al.
D583,135 S 12/2008 Mariman et al.
7,762,009 B2 * 7/2010 Gerber ..... A43B 13/26 36/59 C
8,375,604 B2 2/2013 Eder et al.
8,584,379 B2 11/2013 Baucom et al.
9,072,333 B2 7/2015 Droege et al.
D840,654 S 2/2019 Whiteman
D844,952 S 4/2019 Taylor
10,881,168 B2 * 1/2021 Markison ..... A43B 23/0235
2002/0184793 A1 * 12/2002 Sato ..... A43B 13/12 36/114
2004/0181974 A1 * 9/2004 Robinson, Jr. ..... A43B 19/00 36/100
2006/0130361 A1 * 6/2006 Robinson, Jr. ..... A43B 13/10 36/102
2007/0062070 A1 3/2007 Kuhtz et al.
2007/0107264 A1 * 5/2007 Meschter ..... A43B 5/12 36/76 R
2008/0098624 A1 5/2008 Goldman
2009/0056169 A1 3/2009 Robinson et al.
2011/0047834 A1 * 3/2011 Baker ..... A43B 13/223 36/67 A
2012/0073160 A1 3/2012 Marvin et al.
2013/0067778 A1 * 3/2013 Minami ..... A43C 15/162 36/59 R
2014/0215853 A1 * 8/2014 Rushbrook ..... A43C 15/162 36/102
2017/0202301 A1 * 7/2017 Amis ..... A43B 5/02
2020/0170338 A1 * 6/2020 Lucca ..... A43B 13/12
2020/0315285 A1 * 10/2020 Winskowicz ..... A43B 5/001

* cited by examiner

SOLE STRUCTURE FOR ARTICLE OF FOOTWEAR

CROSS REFERENCE TO RELATED APPLICATION

This non-provisional U.S. Patent Application claims priority under 35 U.S.C. § 119(e) to U.S. Provisional Patent Application Ser. No. 62/980,606, filed Feb. 24, 2020, the disclosure of which is hereby incorporated by reference in its entirety.

FIELD

The present disclosure relates generally to sole structures for articles of footwear, and more particularly to sole structures incorporating traction elements.

BACKGROUND

This section provides background information related to the present disclosure which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. The outsole may include one or more traction elements or cleats for engaging a ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. Sole structures may also include a comfort-enhancing insole or a sockliner located within a void proximate to the bottom portion of the upper and a strobel attached to the upper and disposed between the midsole and the insole or sockliner.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
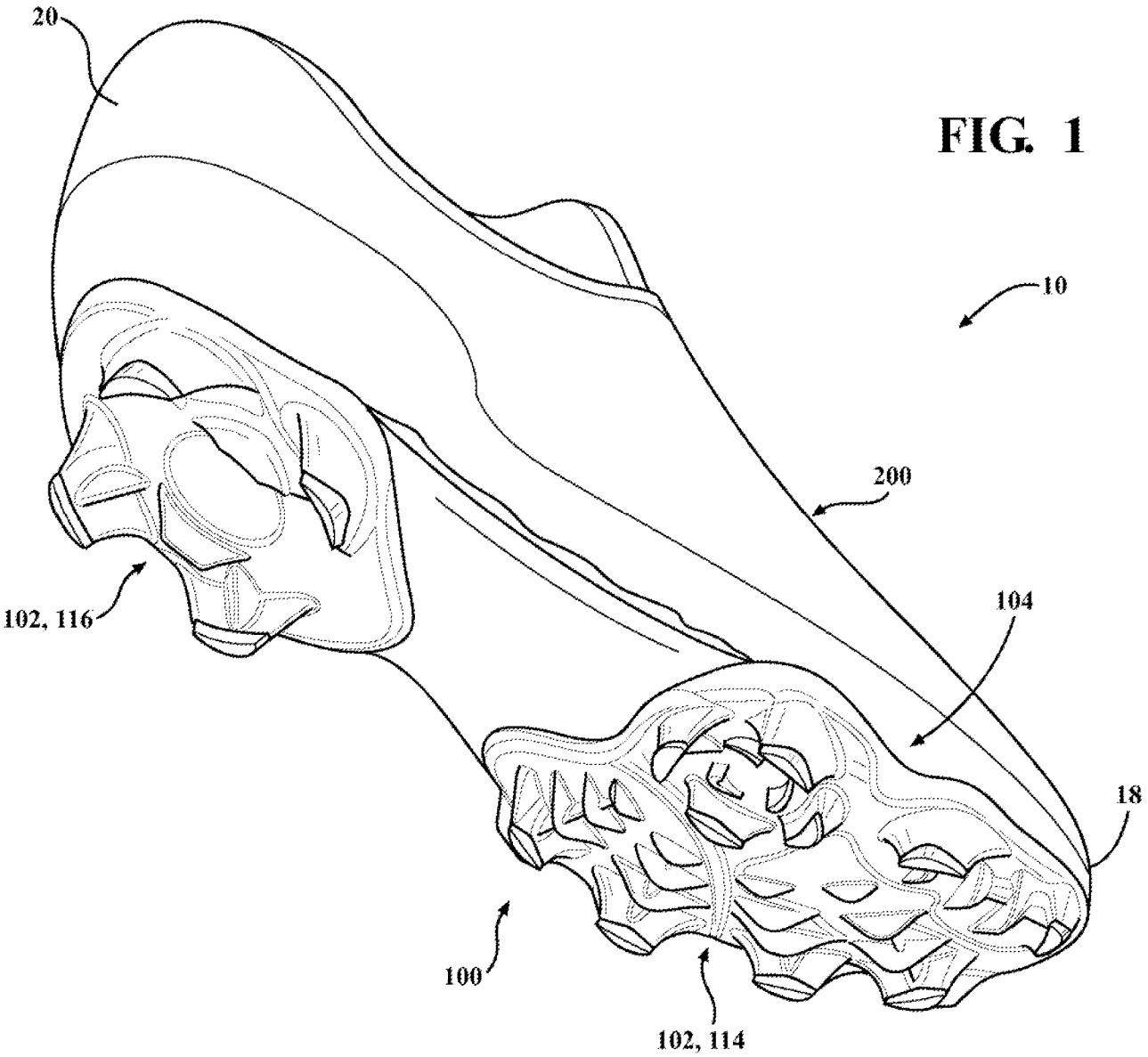
FIG. 1 is a bottom perspective view of an article of footwear in accordance with principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

One aspect of the disclosure provides an outsole for an article of footwear. The outsole has a plantar surface and a peripheral surface surrounding the plantar surface. The outsole includes an annular cleat set including a first plurality of traction elements arranged in series about a central axis on the plantar surface. The outsole also includes one or more radial cleat sets each including a second plurality of the traction elements aligned along a respective radial axis intersecting the central axis. At least one of the second plurality of the traction elements includes a peripheral cleat formed on the peripheral surface.

Implementations of the disclosure may include one or more of the following optional features. In some implementations, the annular cleat set is disposed on a medial side of the outsole. The annular cleat set may be disposed in a forefoot region of the outsole. Optionally, the annular cleat set may be disposed in a ball portion of the outsole.

In some examples, the first plurality of traction elements includes a plurality of major cleats and a plurality of minor cleats. Here, the plurality of major cleats may be arranged in a first ring about the central axis and the plurality of minor cleats may be arranged in a second ring about the central axis. The first ring may have a larger diameter than the second ring. The major cleats may have a greater height than the minor cleats. One or more of the major cleats may include a reinforcing rib extending toward the central axis. A width of each of the major cleats and each of the minor cleats may taper.

In some configurations, the one or more radial cleat sets includes one or more lateral radial cleat sets disposed adjacent to a lateral side of the outsole. The one or more lateral radial cleat sets may be disposed in a forefoot region of the outsole. Optionally, the one or more lateral radial cleat sets may include a first lateral radial cleat set disposed in ball portion of the outsole and a second lateral radial cleat set disposed in a toe portion of the outsole. The second plurality of the traction elements of each of the one or more lateral radial cleat sets may include a plurality of minor cleats disposed on the plantar surface, and a major cleat disposed on the plantar surface between the peripheral cleat and the plurality of minor cleats. Here, the major cleat may have a greater height than each of the minor cleats. The plurality of minor cleats may decrease in size along a direction from the major cleat to the central axis. The peripheral cleat may extend at an oblique angle relative to the major cleat.

In some implementations, the one or more radial cleat sets includes an anterior radial cleat set disposed at an anterior end of the outsole. Here, the anterior radial cleat set may be disposed on a medial side of the outsole. The second plurality of the traction elements of the anterior radial cleat set may include a major cleat disposed on the plantar surface adjacent to the peripheral surface, and a plurality of minor cleats disposed between the major cleat and the central axis.

In some examples, a heel cleat set is disposed in a heel region of the outsole and includes a third plurality of the traction elements. Here, the heel cleat set may include a plurality of major cleats and a plurality of minor cleats, the major cleats having a greater height than the minor cleats. The outsole may include a first plate having the annular cleat set and the one or more radial cleat sets, and a second plate having the heel cleat set. Optionally, at least one of the first plate and the second plate may be a modular structure including a shell formed of a first material and a skeleton received within the shell and formed of a second material. Here, the skeleton may form a first portion of one of the traction elements and the shell may form a second portion of the one of the traction elements. The one of the first plate and the second plate may include an insert forming a third portion of the one of the traction elements.

In some configurations, a major cleat is disposed on the plantar surface between the annular cleat set and one of the one or more radial cleat sets. Here, the major cleat may be disposed on a medial side of the outsole. A sole structure may include the outsole. Additionally or alternatively, an article of footwear may include the outsole.

Another aspect of the disclosure provides a sole structure for an article of footwear. The sole structure includes a midsole having a top surface and a bottom surface formed on an opposite side than the top surface. The sole structure also includes an outsole attached to the bottom surface of the midsole and including an annular cleat set. The annular cleat set includes a first plurality of traction elements arranged in series about a central axis on a plantar surface of the outsole. The sole structure also includes one or more radial cleat sets each including a second plurality of the traction elements aligned along a respective radial axis intersecting the central axis. At least one of the second plurality of the traction elements includes a peripheral cleat formed on a peripheral surface of the outsole.

This aspect may include one or more of the following optional features. In some examples, the second plurality of the traction elements includes a plurality of minor cleats disposed on the plantar surface and a major cleat disposed on the plantar surface between the peripheral cleat and the plurality of minor cleats. Optionally, the outsole may include a forefoot plate attached to the bottom surface of the midsole in a forefoot region and including the annular cleat set and the one or more radial cleat sets, and a heel plate attached to the bottom surface of the midsole in a heel region. Here, at least one of the forefoot plate and the heel plate may be formed as a modular component. Additionally or alternatively, a shank may be attached to the bottom surface of the midsole and disposed between the forefoot plate and the heel plate. Here, a cradle may be attached to the shank and disposed between the forefoot plate and the heel plate.

In some implementations, the midsole includes a casing formed of a first material and a core formed of a second material disposed within the casing. The core may extend from a forefoot region to a heel region. The midsole may include a recess formed in a top surface of the midsole, the core may be disposed within the recess. An article of footwear may include the sole structure.

The details of one or more implementations of the disclosure are set forth in the accompanying drawings and the description below. Other aspects, features, and advantages will be apparent from the description and drawings, and from the claims.

Referring to FIGS. 1-11, an article of footwear 10 includes a sole structure 100 and an upper 200. As illustrated in FIG. 6A, the article of footwear 10 may be divided into one or more regions. The regions may include a forefoot region 12, a mid-foot region 14, and a heel region 16. The forefoot region 12 may be subdivided into a toe portion $\mathbf{12}_T$ corresponding with phalanges, and a ball portion $\mathbf{12}_B$ associated with metatarsal bones of a foot. The mid-foot region 14 may correspond with an arch area of the foot, and the heel region 16 may correspond with rear portions of the foot, including a calcaneus bone.

Figure 6A:
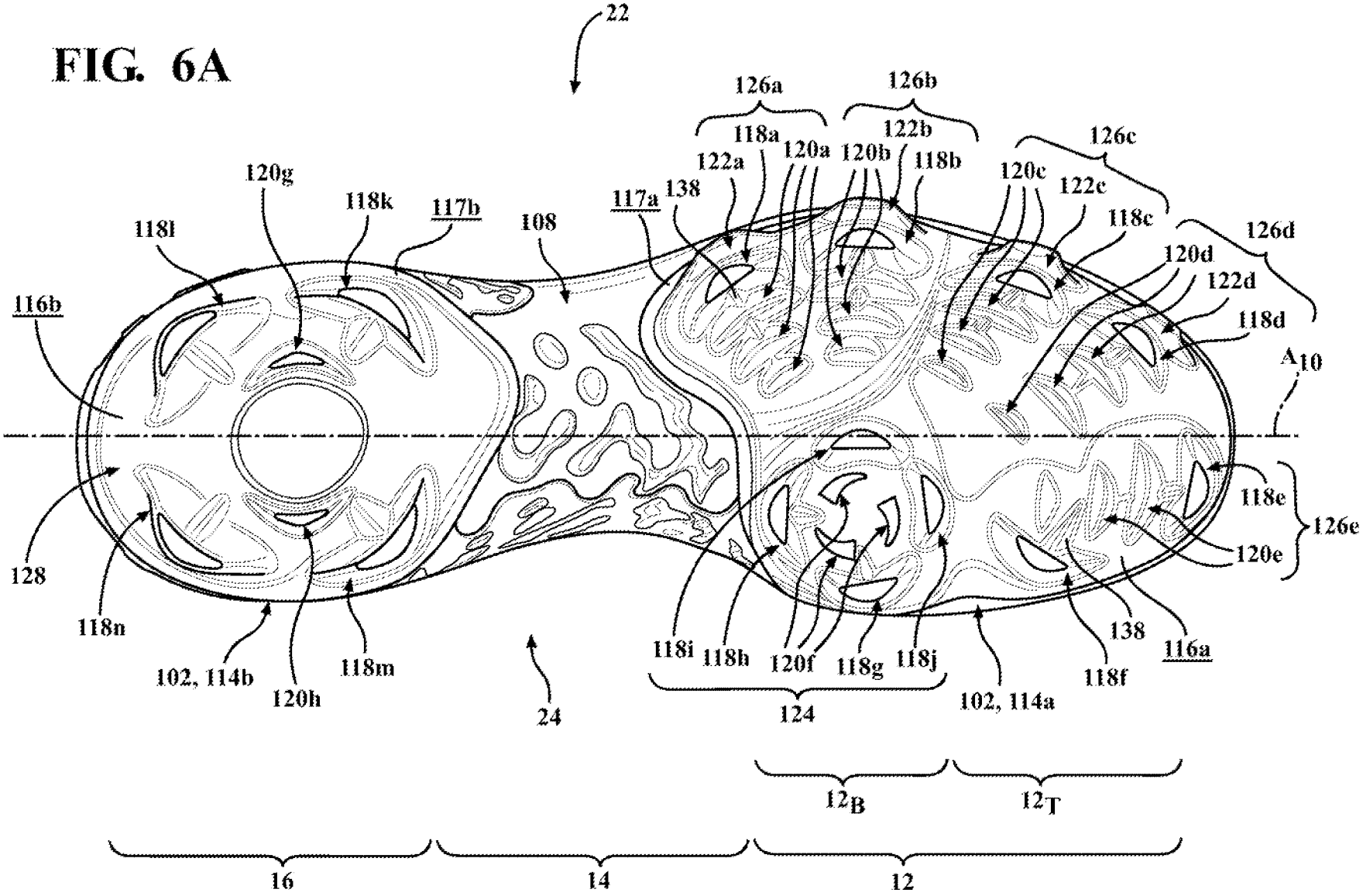
FIGS. 6A and 6B are bottom plan views of the article of footwear of FIG. 1.

The footwear 10 may further include an anterior end 18 associated with a forward-most point of the forefoot region 12, and a posterior end 20 corresponding to a rearward-most point of the heel region 16. As shown in FIG. 6A, a longitudinal axis $A_{10}$ of the footwear 10 extends along a length of the footwear 10 from the anterior end 18 to the posterior end 20. The longitudinal axis $A_{10}$ is centrally located along the length of the footwear 10, and generally divides the footwear 10 into a lateral side 22 and a medial side 24. Accordingly, the lateral side 22 and the medial side 24 respectively correspond with opposite sides of the footwear 10 and extend through the regions 12, 14, 16. As used herein, a longitudinal direction refers to the direction extending from the anterior end 18 to the posterior end 20, while a lateral direction refers to the direction transverse to the longitudinal direction and extending from the lateral side 22 to the medial side 24.

Figure 2:
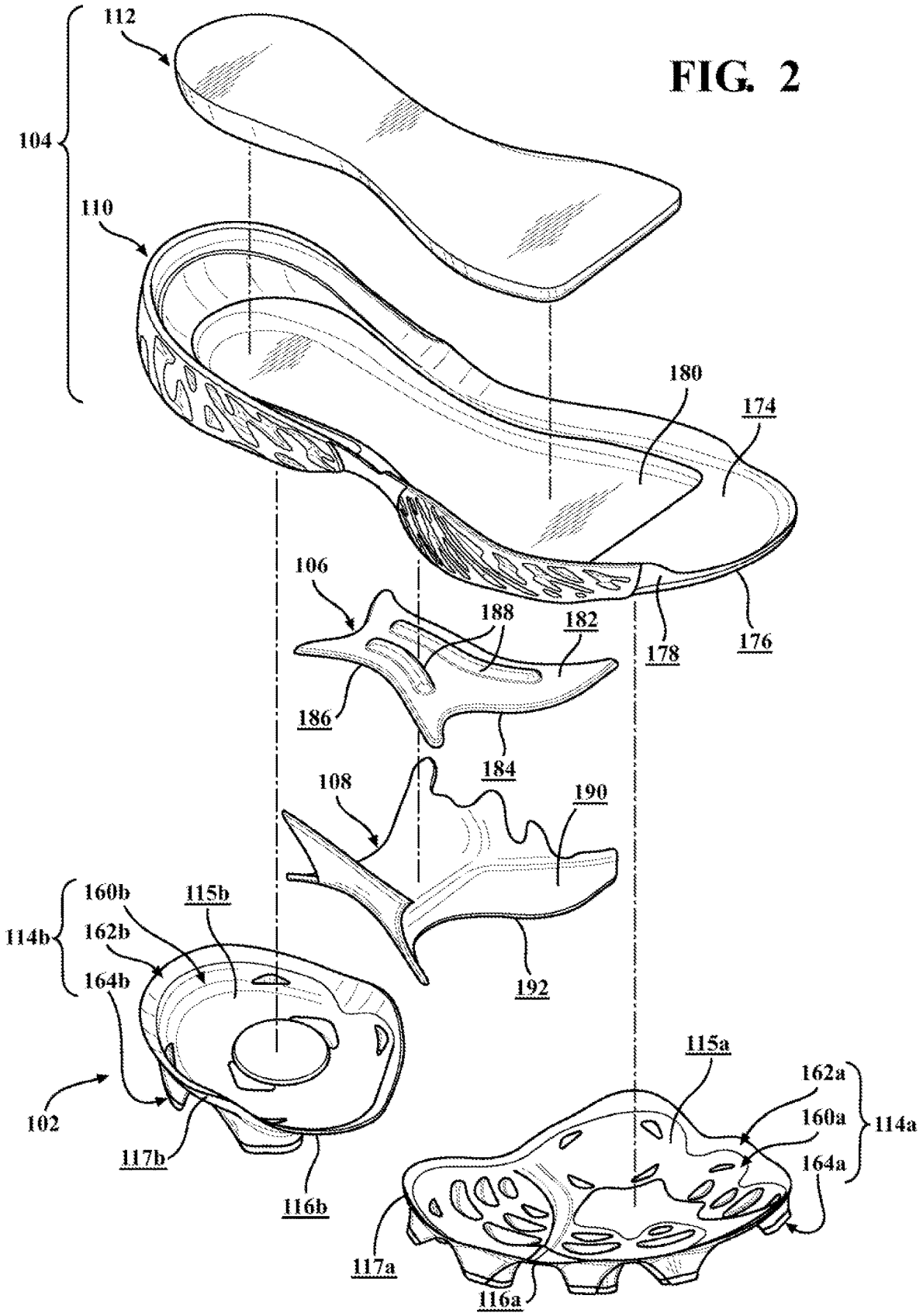
FIG. 2 is an exploded perspective view of the article of footwear of FIG. 1.

Unlike conventional sole structures, which may have a unitary construction, the sole structure 100 of the illustrated example is formed compositely and includes a plurality of subcomponents for providing desired characteristics of cushioning, stiffness, traction, and durability. As shown in FIG. 2, the sole structure 100 includes an outsole 102, a midsole 104, a shank 106, and a cradle 108. The midsole 104 is configured to provide one or more layers of cushioning between the upper 200 and a ground-engaging surface 26. Optionally, the midsole 104 may include an outer casing 110 and a core 112 disposed within the casing 110, as described in greater detail below. The outsole 102 is configured to provide a durable ground-engaging surface for the article of footwear and includes a plurality of traction elements for interfacing with the ground surface.

With continued reference to FIG. 2, the outsole 102 includes a forefoot plate 114*a* disposed in the forefoot region 12 and including a first plurality of traction elements, and a heel plate 114*b* disposed in the heel region and including a second plurality of traction elements. Each of the plates 114*a*, 114*b* may be described as including a top surface 115*a*, 115*b* facing the upper 200, a bottom surface 116*a*, 116*b* formed on an opposite side of the plate 114*a*, 114*b* from the top surface 115*a*, 115*b*, and a peripheral surface 117*a*, 117*b* extending from the top surface 115*a*, 115*b* to the bottom surface 116*a*, 116*b*. Here, the bottom surfaces 116*a*, 116*b* are associated with a plantar (downward-facing) portion of each of the plates 114*a*, 114*b*. The peripheral surfaces 117*a*, 117*b* are formed at an oblique angle relative to the bottom surfaces 116*a*, 116*b* and form an outer periphery of each plate 114*a*, 114*b*. In the illustrated example, the peripheral surfaces 117*a*, 117*b* flare outwardly in a direction from the bottom surfaces 116*a*, 116*b* to the top surface 115*a*, 115*b*.

Figure 6B:
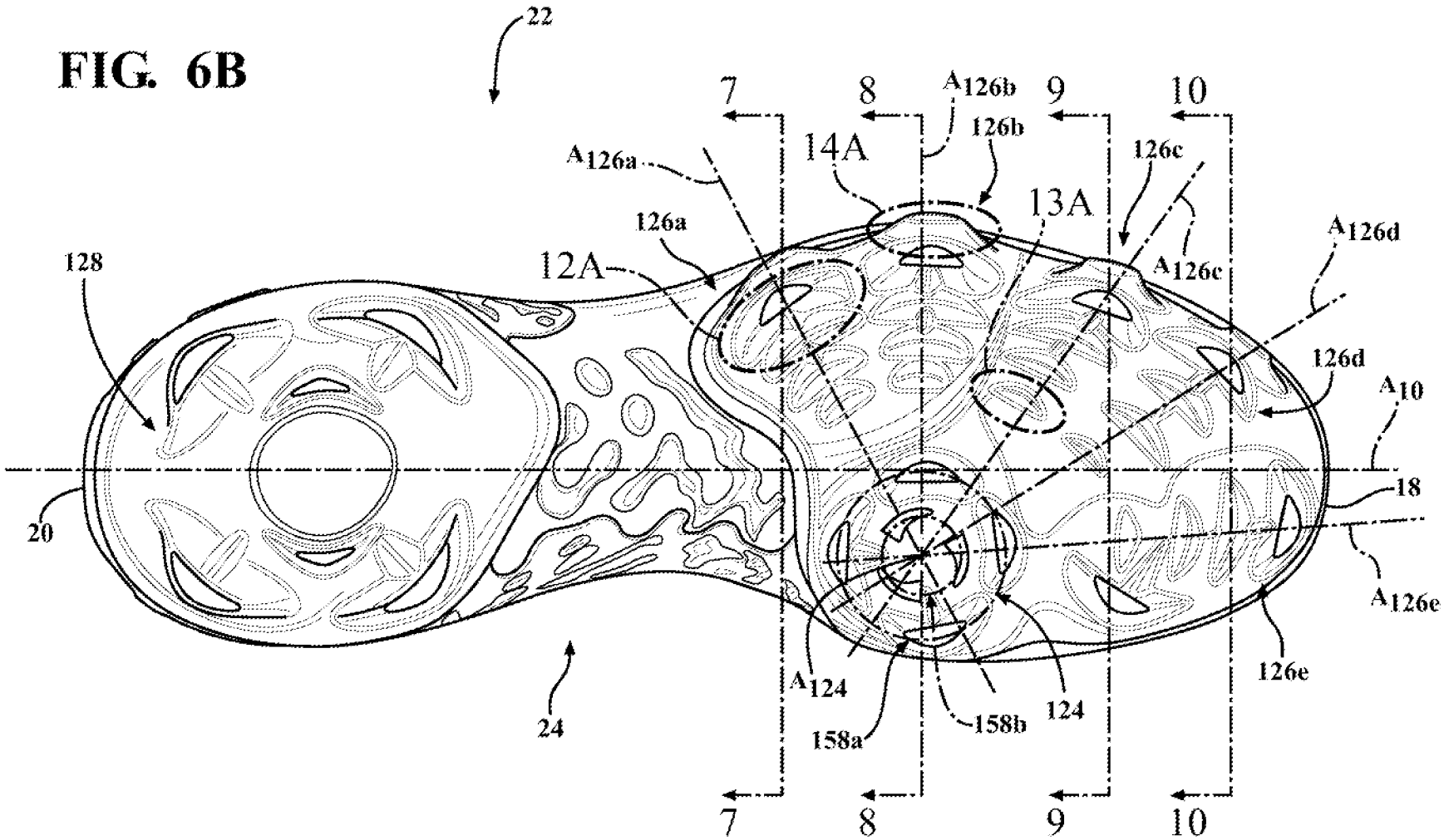
Figure 8:
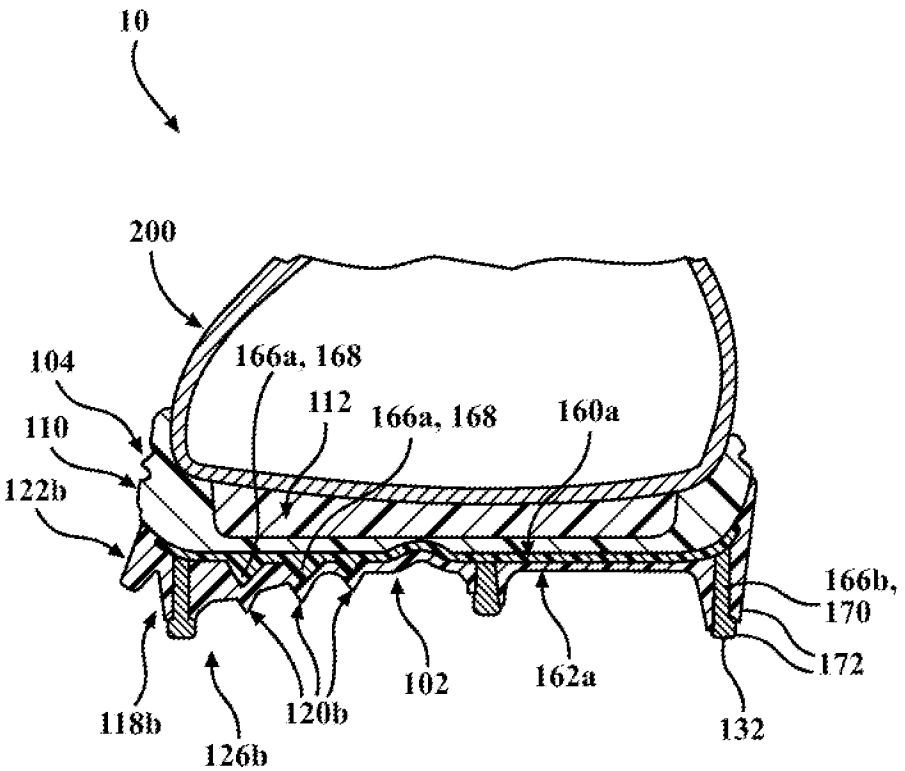
FIG. 8 is a cross-sectional view of the article of footwear of FIG. 1, taken along section line 8-8 of FIG. 6B.
Figure 7:
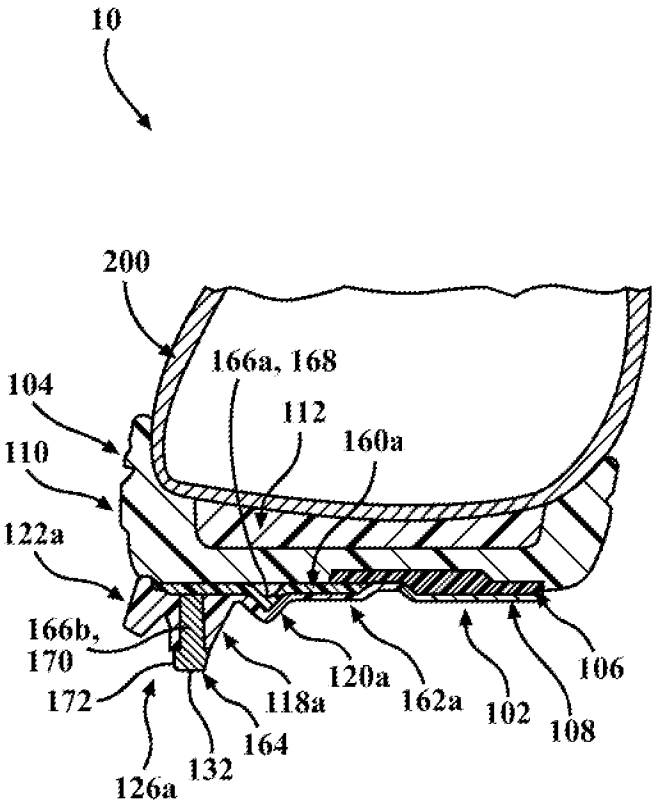
FIG. 7 is a cross-sectional view of the article of footwear of FIG. 1, taken along section line 7-7 of FIG. 6B.
Figure 10:
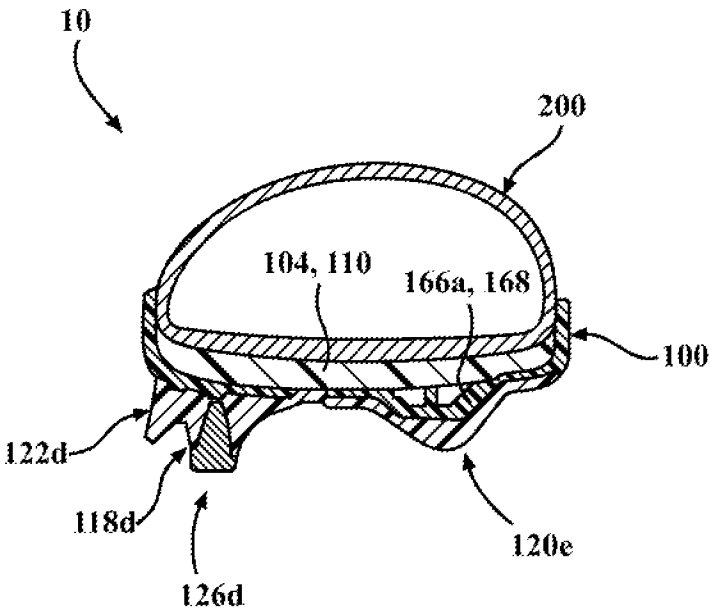
FIG. 10 is a cross-sectional view of the article of footwear of FIG. 1, taken along section line 10-10 of FIG. 6B.
Figure 9:
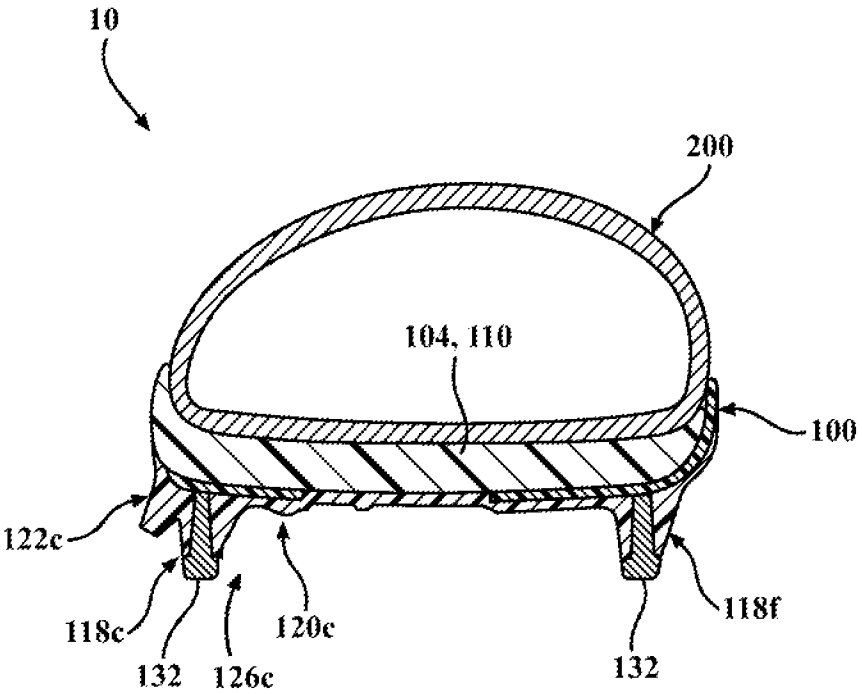
FIG. 9 is a cross-sectional view of the article of footwear of FIG. 1, taken along section line 9-9 of FIG. 6B.
Figure 11:
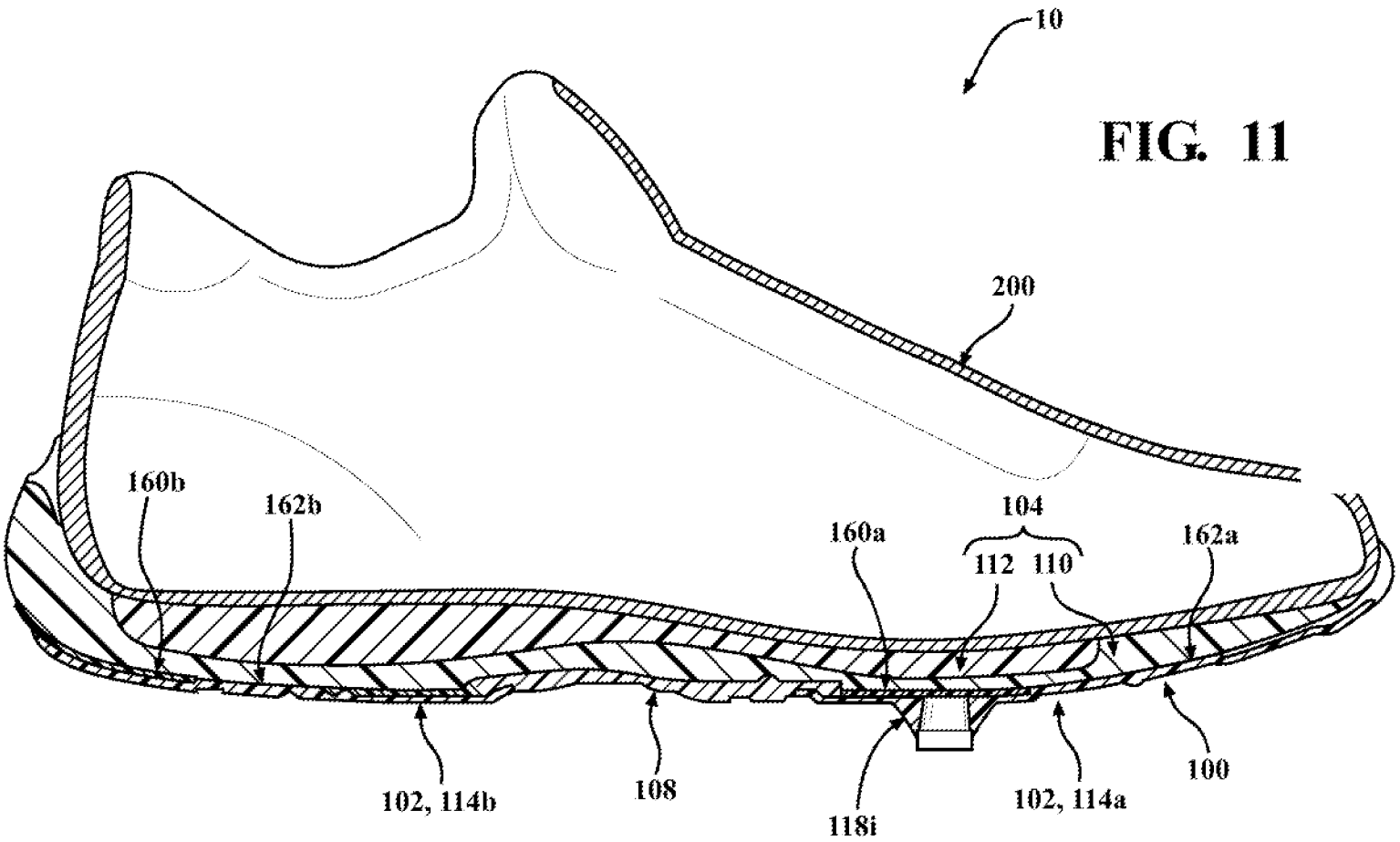
FIG. 11 is a longitudinal cross-sectional view of the article of footwear of FIG. 1, taken along line $A_{10}$ of FIG. 6B.

With reference to FIG. 6A, the traction elements of the outsole 102 may be described as including major cleats 118*a*-118*n*, minor cleats 120*a*-120*h*, and peripheral cleats 122*a*-122*d*. Generally, the major cleats 118*a*-118*n* and the minor cleats 120*a*-120*h* are formed on a plantar portion (e.g., the bottom surfaces 116*a*, 116*b*) of the outsole 102 and are configured to provide traction with the ground surface when a normal force is applied to the ground surface by the plantar surface of the sole structure 100. The peripheral cleats 122*a*-122*d* project outwardly from a peripheral portion of the outsole 102 (i.e., the peripheral surfaces 117*a*, 117*b*) and are configured to engage the ground surface when a lateral or angular force is applied in a direction towards the lateral side 22 of the sole structure 100. As best shown in FIG. 6B, the traction elements 118*a*-118*n*, 120*a*-120*h*, 122*a*-122*d* may cooperate with each other to define a plurality of cleat sets including an annular cleat set 124 disposed in the ball portion $\mathbf{12}_B$ on the medial side 24 of the forefoot plate 114*a*, a plurality of radial cleat sets 126*a*-126*e* arranged along the lateral side 22 and/or in the toe portion $\mathbf{12}_T$ of the forefoot plate 114*a*, and a heel cleat set 128 disposed in the heel region 16 on the heel plate 114*b*.

Figure 12A:
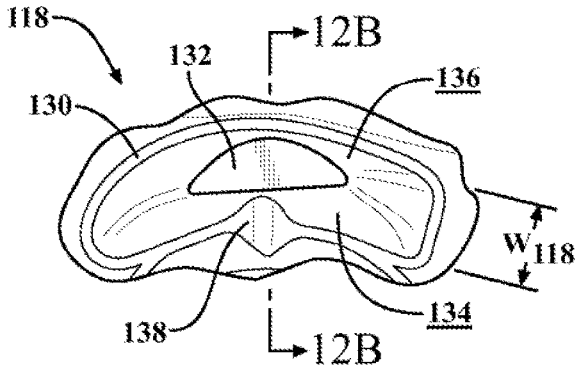
FIG. 12A is a plan view of an example of a major cleat of the article of footwear of FIG. 1, taken at area 12A of FIG. 6B.
Figure 12B:
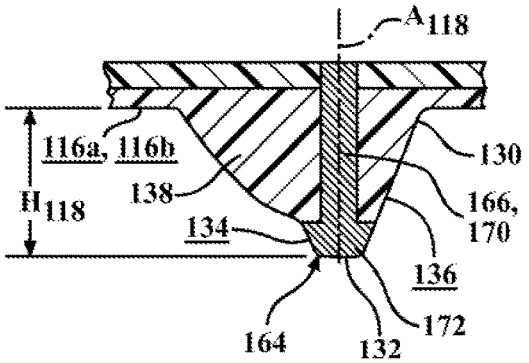
FIG. 12B is a cross-sectional view of the example of the major cleat of FIG. 12A, taken along section line 12B-12B of FIG. 12A.

Referring now to FIGS. 12A and 12B, a generic example 118 of one of the major cleats 118*a*-118*n* is illustrated. While the sizing and/or the geometry of each of the major cleats 118*a*-118*b* may be different, each of the major cleats 118*a*-118*n* includes at least the features described with respect to the example major cleat 118 of FIGS. 12A and 12B, unless otherwise specified. As shown, a height $H_{118}$ of each of the major cleats 118*a*-118*n* extends along an axis $A_{118}$ from a base 130 proximal to a bottom surface 116*a*, 116*b* of the sole structure 100 to a tip 132 disposed at an opposite end of the major cleat 118*a*-118*n* than the base 130. Here, the tip 132 is defined by a substantially planar distal surface, such that the tip 132 defines a flat end at each of the major cleats 118*a*-118*n*. An outer periphery of each of the major cleats 118*a*-118*n* is defined by the cooperation of a concave inner surface 134 and a convex outer surface 136, which converge with each other along a direction from the base 130 to the tip 132 to provide each of the major cleats 118*a*-118*n* with a tapering width $W_{118}$. Furthermore, the inner surface 134 and the outer surface 136 may converge with each other at opposite ends of the major cleats 118*a*-118*n* such that the width $W_{118}$ tapers along a lengthwise direction from a central portion of each of the major cleats 118*a*-118*n*. Thus, the major cleats 118*a*-118*n* may be described as having a crescent-shaped cross section. Optionally, one or more of the major cleats 118*a*-118*n* may be formed with a reinforcing rib 138 projecting radially from the concave inner surface 134.

Figure 13A:
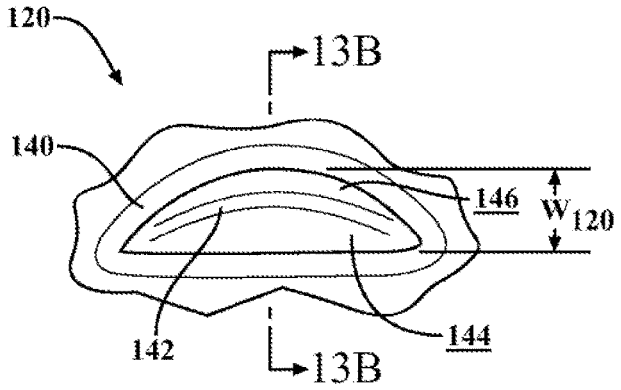
FIG. 13A is a plan view of an example of a minor cleat of the article of footwear of FIG. 1, taken at area 13A of FIG. 6B.
Figure 13B:
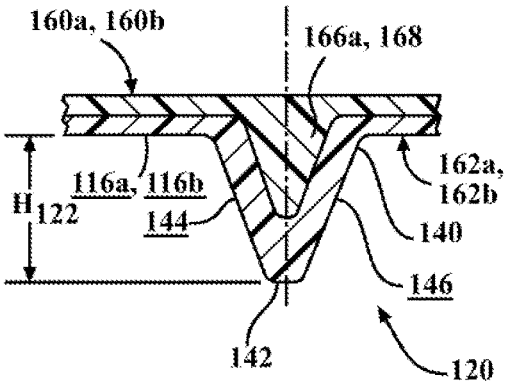
FIG. 13B is a cross-sectional view of the example of the minor cleat of FIG. 13A, taken along section line 13B-13B of FIG. 13A.

As shown in FIGS. 13A and 13B, a generic example 120 of one of the minor cleats 120*a*-120*h* is illustrated. While the sizing and/or the geometry of each of the minor cleats 120*a*-120*h* may be different, each of the minor cleats 120*a*-120*h* may include at least the generic features described with respect to the example minor cleat 120 of FIGS. 13A and 13B. As shown, a height $H_{120}$ of each of the minor cleats 120*a*-120*h* extends along an axis $A_{120}$ from a base 140 proximal to a bottom surface 116*a*, 116*b* of the sole structure 102 to an edge 142 disposed at an opposite end of the minor cleat 120*a*-120*h* than the base 140. Here, the edge 142 is substantially continuous along a length of the minor cleat 120*a*-120*h*. An outer periphery of each of the minor cleats 120*a*-120*h* is defined by the cooperation of a concave inner surface 144 and a convex outer surface 146, which converge with each other along a direction from the base 140 to the edge 142. Furthermore, the inner surface 144 and the outer surface 146 may converge with each other at opposite ends of the minor cleats 120*a*-120*h* such that the width $W_{120}$ tapers along a lengthwise direction from a central portion of each of the minor cleats 120*a*-120*h*. Thus, the minor cleats 120*a*-120*h* may be described as having a crescent-shaped cross section. While the heights $H_{120}$ of the minor cleats 120*a*-120*h* may be different from each other, the heights $H_{120}$ of all of the minor cleats 120*a*-120*h* are less than the heights $H_{118}$ of all of the major cleats 118*a*-118*n*.

Figure 14A:
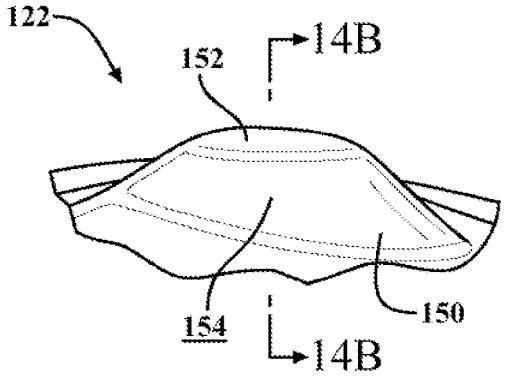
FIG. 14A is a plan view of an example of a peripheral cleat of the article of footwear of FIG. 1, taken are area 14A of FIG. 6B.
Figure 14B:
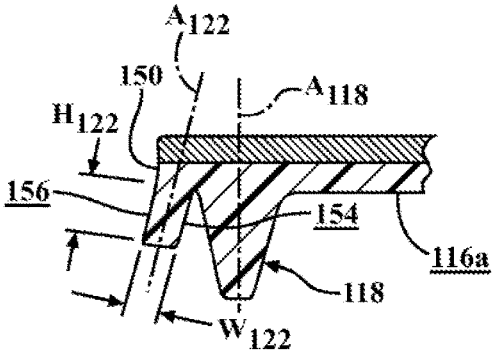
FIG. 14B is a cross-sectional view of the example of the peripheral cleat of FIG. 14A, taken along section line 14B-14B of FIG. 14A.

As shown in FIGS. 14A and 14B, a generic example 122 of one of the peripheral cleats 122*a*-122*d* is illustrated. While the sizing and/or geometry of each of the peripheral cleats 122*a*-122*d* may be different, each of the peripheral cleats 122*a*-122*d* may include at least the generic features described with respect to the example peripheral cleat 122 of FIGS. 14A and 14B. As shown, a height $H_{122}$ of each of the peripheral cleats 122*a*-122*d* extends along an axis $A_{122}$ from a base 150 proximal to a bottom surface of the sole structure 102 to a tip 152 disposed at an opposite end of the peripheral cleat 122*a*-122*d* than the base 150. Unlike the major cleats 118*a*-118*n*, which extend substantially perpendicular from the bottom surface 116*a*, 116*b* of the sole structure 102, the peripheral cleats 122*a*-122*d* extend from the peripheral surface 117*a* at an oblique angle relative to the bottom surface 116*a* such that the tip 152 is defined by a substantially planar surface oriented at an oblique angle relative to the bottom surface 116*a* of the sole structure 102. An outer periphery of each of the peripheral cleats 122*a*-122*d* is defined by the cooperation of a convex inner surface 154 and a convex outer surface 156, which converge with each other along a direction from the base 150 to the tip 152. Furthermore, the inner surface 154 and the outer surface 156 may converge with each other at opposite ends of the peripheral cleats 122*a*-122*d* such that the width $W_{122}$ tapers along a lengthwise direction from a central portion of each of the peripheral cleats 122*a*-122*d*. Thus, the peripheral cleats 122*a*-122*d* may be described as having an ellipsoidal cross section.

Referring again to FIG. 6B, the cleat sets 124, 126*a*-126*e* of the forefoot plate 114*a* are generally arranged relative to an axis $A_{124}$ defined by the annular cleat set 124 and located in the ball portion $\mathbf{12}_B$ on the medial side 24. More particularly, the annular cleat set 124 includes a plurality of the major cleats 118*g*-118*j* and the minor cleats 120*f* arranged in an annular pattern about the central axis $A_{124}$, while each of the radial cleat sets 126*a*-126*e* includes a respective series of traction elements including major cleats 118*a*-118*e*, minor cleats 120*a*-120*e*, and/or peripheral cleats 122*a*-122*d* aligned along a respective radial axis $A_{126a}$-$A_{126e}$ that intersects the central axis $A_{124}$, as described in greater detail below. Thus, the radial cleat sets 126*a*-126*e* are arranged in series in a radial array about the annular cleat set 124.

With continued reference to FIGS. 6A and 6B, the annular cleat set 124 includes an outer ring 158*a* including a series of the major cleats 118*g*-118*j* arranged along a first circle about the central axis $A_{124}$. Here, the major cleats 118*g*-118*j* of the outer ring 158*a* may be evenly spaced from each other along the circumference of the outer ring 158*a*. Optionally, one or more of the major cleats 118*g*, 118*h* may include a reinforcing rib 138 extending inwardly towards the central axis $A_{124}$, as described above.

In addition to the outer ring 158*a*, the annular cleat set 124 may include an inner ring 158*b* including a series of minor cleats 120*f* arranged along a second circle about the central axis $A_{124}$. As shown, a diameter of the inner ring 158*b* is less than a diameter of the outer ring 158*a*, such that the inner ring 158*b* is concentric with and surrounded by the outer ring 158*a*. In the inner ring 158*b*, widths $W_{120}$ each of the minor cleats 120*f* of the inner ring 158*b* taper continuously from a first end to a second end along the circumference of the inner ring 158*b*. As shown, each of the minor cleats 120*f* tapers along the same direction (e.g., clockwise). It will be appreciated that the minor cleats 120*f* may taper along the opposite direction (e.g., counterclockwise) on an article of footwear 10 associated with the opposite foot (e.g., the left foot) of the user.

Referring still to FIGS. 6A and 6B, the forefoot plate 114*a* includes a plurality of lateral radial cleat sets 126*a*-126*d* arranged along the lateral side 22 of the forefoot plate 114*a*. Each of the lateral radial cleat sets 126*a*-126*d* includes a respective major cleat 118*a*-118*d* disposed on the bottom surface 116*a* adjacent to the peripheral surface 117*a*, a series of minor cleats 120*a*-120*d* disposed on the bottom surface 116*a* between the respective major cleat 118*a*-118*d* and the annular cleat set 124, and a respective peripheral cleat 122*a*-122*d* disposed on the peripheral surface 117*a* (FIGS. 7-10), outwardly of the respective major cleat 118*a*-118*d*. The major cleat 118*a*-118*d*, the minor cleats 120*a*-120*d*, and the peripheral cleats 122*a*-122*d* of each lateral radial cleat set 126*a*-126*d* are arranged in series along the respective radial axis $A_{124a}$-$A_{124a}$.

As shown, the minor cleats 120*a*-120*d* of each of the cleat sets 126*a*-126*d* are arranged in series such that sizes (e.g., height, width, and/or length) of the minor cleats 120*a*-120*d* progressively decrease along the direction of the respective radial axis $A_{126a}$-$A_{126a}$ from the major cleat 118*a*-118*d* towards the annular cleat set 124. In other words, a minor cleat 120*a*-120*d* disposed closer to the respective major cleat 118*a*-118*d* of the radial cleat set 126*a*-126*d* will have a larger size than a minor cleat 120*a*-120*d* that is farther from the respective major cleat 118*a*-118*d*. In each of the lateral radial cleat sets 126*a*-126*d*, an outer surface 146 of the minor cleat 120*a*-120*d* adjacent to the major cleat 118*a*-118*d* may be connected to the inner surface 134 of the respective major cleat 118*a*-118*d* by one of the reinforcing ribs 138. Optionally, the reinforcing ribs 138 may extend between and connect successive ones of the minor cleats 120*a*-120*d* to each other.

As shown in FIG. 6B, the lateral radial cleat sets 126*a*-126*d* include a first lateral radial cleat set 126*a* aligned along a first radial axis $A_{126a}$ that intersects the central axis $A_{124}$. In the illustrated example, the first radial axis $A_{126a}$ extends at a first oblique angle relative to the longitudinal axis $A_{10}$, along a direction from the annular cleat set 124 towards the posterior end 20 and the lateral side 22. A second lateral radial cleat set 126*b* is aligned along a second radial axis $A_{126}$ that intersects the central axis $A_{124}$. Here, the second radial axis $A_{126b}$ extends towards the lateral side 22 in a direction substantially perpendicular (e.g. 90±5 degrees) to the longitudinal axis $A_{10}$ of the article of footwear 10. A third lateral radial cleat set 126*c* is aligned along a third radial axis $A_{126e}$ that intersects the central axis $A_{124}$ and extends at a second oblique angle relative to the longitudinal axis $A_{10}$, towards the lateral side 22 and the anterior end 18 of the sole structure 102. A fourth lateral radial cleat set 126*d* is aligned along a fourth radial axis $A_{126a}$ that intersects the central axis $A_{124}$ and extends at a third oblique angle relative to the longitudinal axis $A_{10}$ towards the anterior end 18 and the lateral side 22 of the sole structure 102.

In addition to the lateral radial cleat sets 126*a*-126*d*, which each includes a peripheral cleat 122*a*-122*d*, the radial cleat sets 126*a*-126*e* may include an anterior radial cleat set 126*e* comprising a major cleat 118*e* and a series of minor cleats 120*e* disposed on the medial side 24 in the toe portion $\mathbf{12}_T$. As shown, the traction elements 118*e*, 120*e* of the anterior radial cleat set 126*e* are aligned along a fifth radial axis $A_{126e}$ that is substantially parallel (e.g. 0±5 degrees) to the longitudinal axis $A_{10}$ of the article of footwear 10. As best illustrated in FIG. 6A, the anterior radial cleat 126*e* set includes a major cleat 118*e* disposed on the bottom surface 116*a* of the forefoot plate 114*a* adjacent to the peripheral surface 117*a* at the anterior end 18. A series of the minor cleats 120*e* is aligned with the major cleat 118*e* along the fifth radial axis $A_{126e}$. As discussed above with respect to the lateral radial cleat sets 126*a*-126*d*, the minor cleats 120*e* progressively decrease in size along the direction of the fifth radial axis $A_{126e}$ from the major cleat 118*e* to the annular cleat set 124.

The forefoot plate 114*a* may further include a medial major cleat 118*f* disposed between the anterior radial cleat set 126*e* and the annular cleat set 124 along the peripheral surface 117*a*. Here, the medial major cleat 118*f* is not associated with a cleat set, but is provided as an isolated major cleat 118*f* on the medial side 24 of the sole structure 102. As shown, the medial major cleat 118*f* includes a reinforcing rib 138 extending from the concave inner surface 134, and the convex outer surface 136 of the medial major cleat 118*f* is oriented (i.e., facing) towards the medial side 24 and the posterior end 20.

Referring now to the heel plate 114*b* shown in FIGS. 6A and 6B, the heel cleat set 128 includes a plurality of the major cleats 118*k*-118*n* arranged on the bottom surface 116*b* adjacent to the peripheral surface 117*b*. As shown, the convex outer surfaces 136 of each of the major cleats 118*k*-118*n* face the peripheral surface 117*b*. Each of the major cleats 118*k*-118*n* on the heel plate 114*b* includes a reinforcing rib 138 extending inwardly towards a central portion of the heel plate 114*b*. As shown, the heel cleat set 128 includes a first major cleat 118*k* on the lateral side adjacent to an anterior end of the heel plate 114*b*, a second major cleat 118*l* on the lateral side adjacent to a posterior end of the heel plate 114*b*, a third major cleat 118*m* on the medial side adjacent to the anterior end of the heel plate 114*b*, and a fourth major cleat 118*n* on the medial side adjacent to the posterior end of the heel plate 114*b*.

In addition to the major cleats 118*k*-118*n*, the heel cleat set 128 includes an opposing pair of minor cleats 120*g*, 120*h* disposed in an interior portion of the heel plate 114*b*. For example, a first one of the minor cleats 120*g* is disposed on the lateral side 22 of the heel plate 114*b* and a second one of the minor cleats 120*h* is disposed on the medial side 24 of the heel plate 114*b*, such that the concave inner surfaces 144 of the minor cleats 120*h* face each other across the longitudinal axis $A_{10}$.

Figure 3:
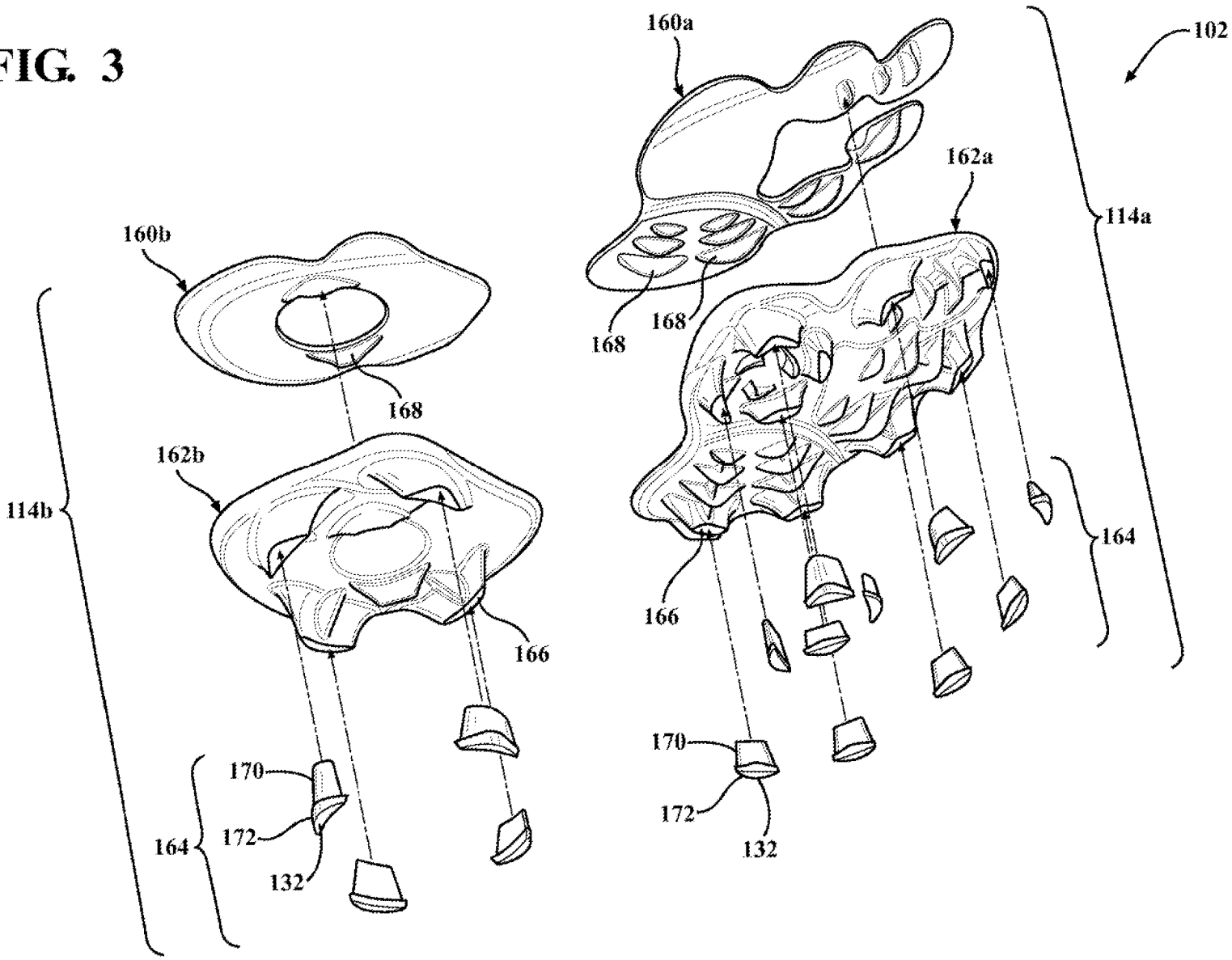
FIG. 3 is an exploded perspective view of an outsole of the article of footwear of FIG. 1.
Figure 4:
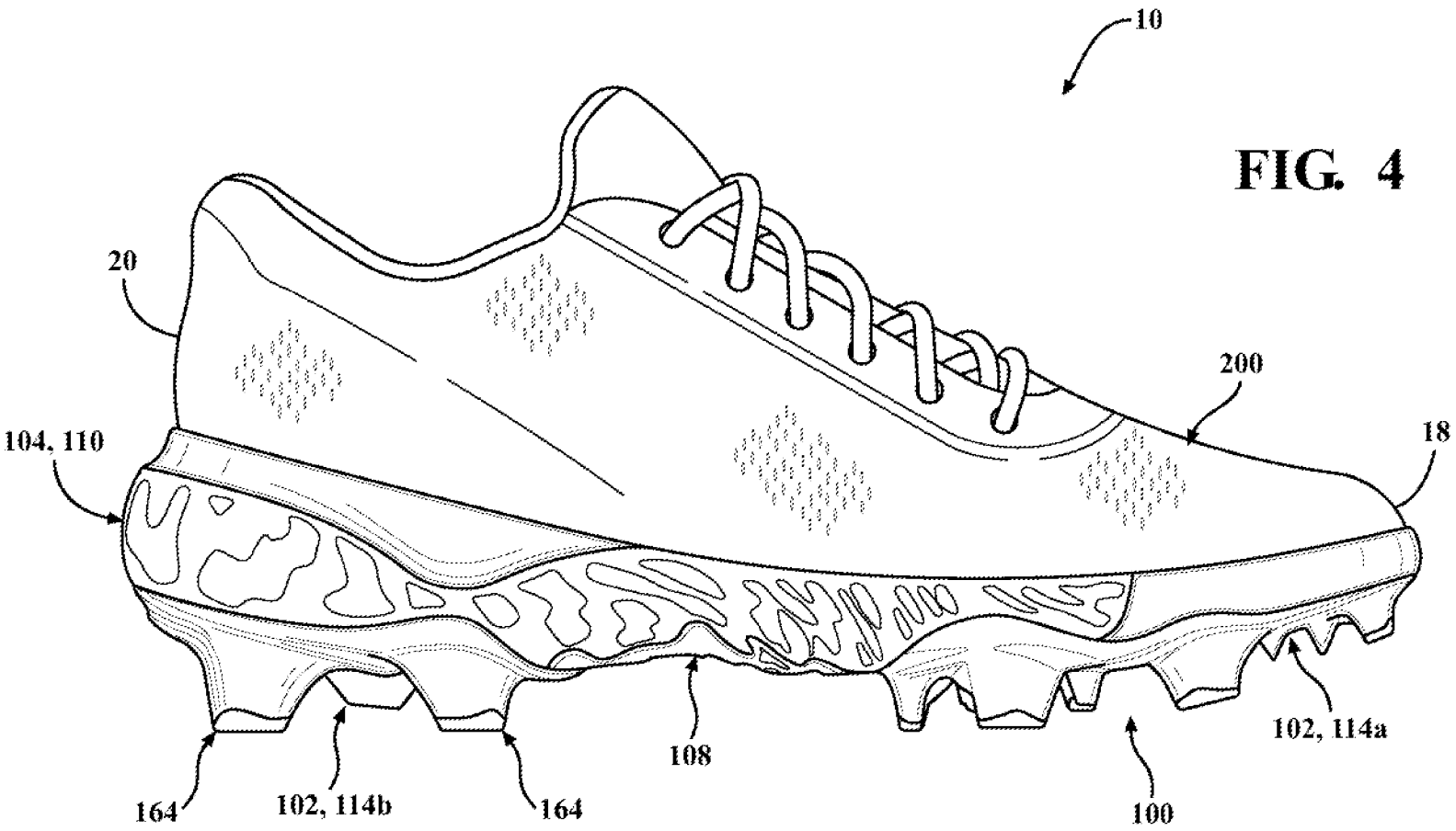
FIG. 4 is a medial side elevation view of the article of footwear of FIG. 1.
Figure 5:
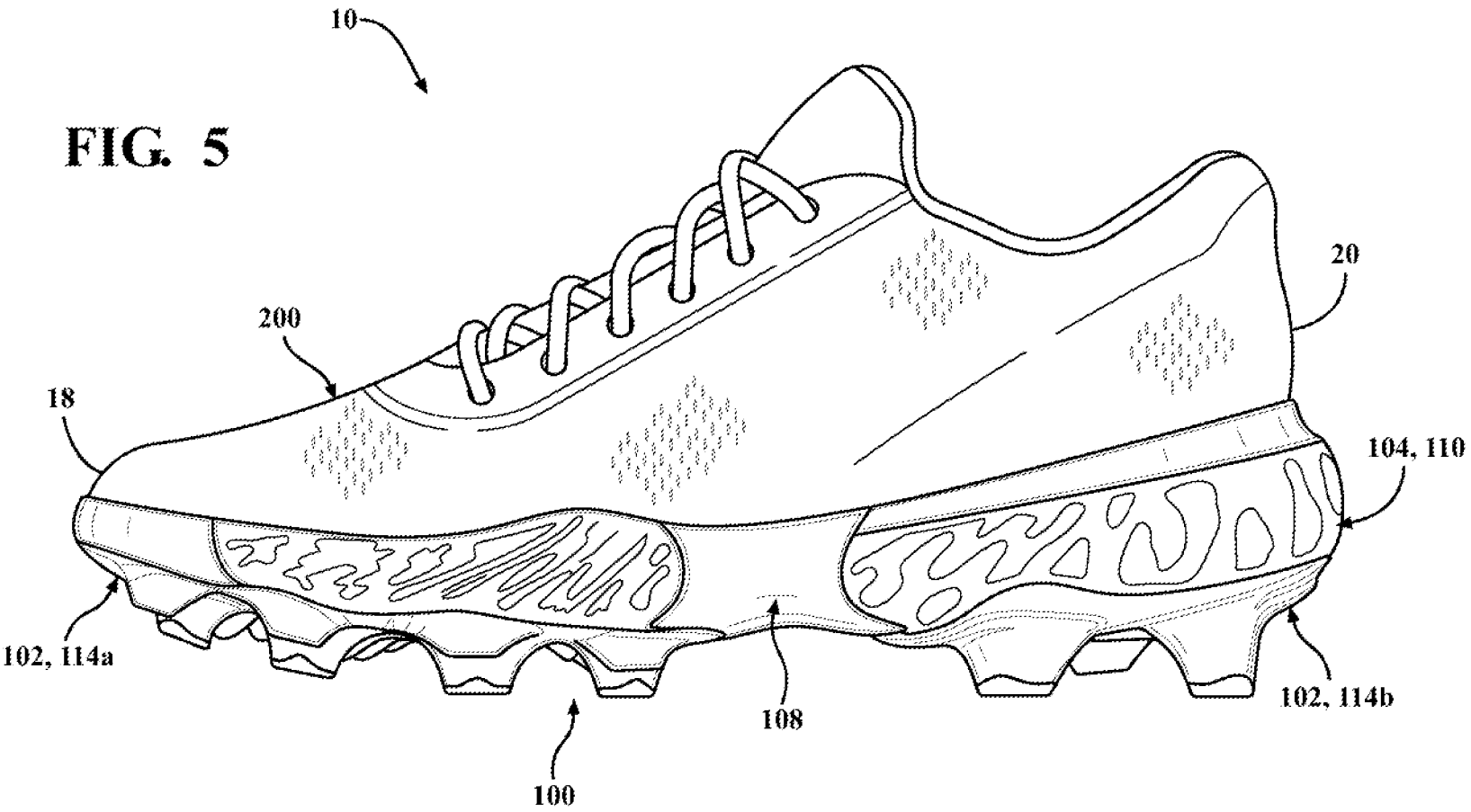
FIG. 5 is a lateral side elevation view of the article of footwear of FIG. 1.

Generally, the outsole plates 114*a*, 114*b* are formed of one or more polymeric and/or composite materials having a greater hardness than the midsole 104. While each of the outsole plates 114*a*, 114*b* may be formed as unitary bodies (i.e., single piece), the outsole plates 114*a*, 114*b* of the illustrated example are embodied as modular or composite structures having a series of subcomponents stacked in a nested arrangement to form each of the plates 114*a*, 114*b*. With particular reference to FIG. 3, each of the plates 114*a* includes an inner skeleton 160*a*, 160*b*, an outer shell 162*a*, 162*b*, and one or more cleat inserts 164, which cooperate to define the outsole plates 114*a*, 114*b* and portions of the traction elements 118*a*-118*n*, 120*a*-120*h*, 122*a*-122*d*.

With continued reference to FIG. 3, the forefoot plate 114*a* includes a forefoot skeleton 160*a* configured to interface with an upper portion of the forefoot shell 162*a* to provide the forefoot plate 114*a* with a laminate structure in regions including the annular cleat set 124 and the radial cleat sets 126*a*-126*f*. As shown in FIG. 2, the forefoot skeleton 160*a* is configured to nest within a recess formed in the top of the forefoot shell 162*a* such that the forefoot skeleton 160*a* and the forefoot shell 162*a* cooperate to form a flush top surface 115*a* of the forefoot plate 114*a*.

With continued reference to FIG. 3, in some examples, portions of the traction elements 118*a*-118*n*, 120*a*-120*h*, 122*a*-122*d* formed by the shells 162*a*, 162*b* may be thin-walled bodies that include a cavity or recess 166*a*, 166*b* extending at least partially through the shell 162*a*, 162*b*. As best shown in FIGS. 7-10, the recesses 166*a*, 166*b* may include a first plurality of recesses 166*a* formed partially through the thickness of the shell 162*a*, 162*b* in areas corresponding to upper portions of the minor cleats 120*a*-120*h*. Here, bottom surfaces of the forefoot skeleton 160*a* and the heel skeleton 160*b* may include one or more protrusions 168 each corresponding to one of the recesses 166*a* formed in the top of the shells 162*a*, 162*b*, such that when the skeleton 160*a*, 160*b* is assembled with the shell 162*a*, 162*b*, the protrusions 168 are received within the recesses 166*a* to provide the respective minor cleat 120*a*-120*h* with a composite structure having an outer layer formed by the material of the shell 162*a*, 162*b* and a core formed by the material of the skeleton 160*a*, 160*b*.

The recesses 166*a*, 166*b* of the shells 162*a*, 162*b* may also include recesses 166*b* formed entirely through the shells 162*a*, 162*b* at the major cleats 118*a*-118*n*. Here, one or more of the major cleats 118*a*-118*n* may be formed, in part, by one of the cleat inserts 164. As shown in FIG. 3, each of the inserts 164 includes a shank 170 configured to be inserted through the portion of the bottom surface 116*a*, 116*b* forming one of the major cleats 118*a*-118*n*, such that the shank 170 is disposed within the recess 166*b* (FIGS. 7-10). Each of the cleat inserts 164 further includes a cap 172 disposed at an end of the shank 170 and configured to form a distal portion of the major cleat 118*a*-118*n* including the tip 132, as shown in FIGS. 3 and 7-10. Accordingly, the major cleats 118*a*-118*n* may also be formed compositely.

Referring again to FIG. 2, the midsole 104 includes one or more materials configured to impart properties of cushioning and resilience to the sole structure 100. While the midsole 104 may be formed as a unitary structure including a single material, the midsole 104 of the illustrated example is formed as a composite structure having the outer casing 110 and the core 112 disposed within the casing 110. The casing 110 and the core 112 may include different materials to impart different characteristics to the midsole 104.

As shown in FIG. 2, the casing 110 extends continuously from the anterior end 18 to the posterior end 20 and includes a top surface 174, a bottom surface 176 formed on an opposite side than the top surface 174, and a peripheral side surface 178 extending between the top surface 174 and the bottom surface 176. The peripheral side surface 178 defines an outer periphery of the casing 110 and the midsole 104. As shown, the top surface 174 may include a recess 180 configured to receive the core 112 therein, such that a top surface of the core 112 is flush and continuous with the top surface 174 of the casing 110 when the sole structure 100 is assembled. The recess 180 and the core 112 extend continuously from the forefoot region 12 to the heel region 16. As shown, a width of the core 112 and the recess 180 may extend substantially across an entire width of the casing 110 from the lateral side 22 to the medial side 24.

The sole structure 100 further includes a shank 106 formed of a material having a greater rigidity than the midsole 104 and configured to be disposed adjacent to the bottom surface 176 of the midsole casing 110 to provide longitudinal support along the bottom of the sole structure 100. In the illustrated example, the shank 106 is interposed between the forefoot plate 114*a* and the heel plate 114*b* on the bottom surface 176 in the mid-foot region 14 of the sole structure 100.

The shank 106 includes a top surface 182 that attaches to the bottom surface 176 of the midsole casing 110 and a bottom surface 184 formed on an opposite side of the shank 106 than the top surface 182. An outer periphery 186 of the shank 106 is configured to interface or mate with the forefoot plate 114*a* at an anterior end of the shank 106 and with the heel plate 114*b* at a posterior end of the shank 106, thereby providing a substantially continuous rigid structure along the bottom surface 176 of the midsole casing 110 from the anterior end 18 to the posterior end 20. In some examples, the top and/or bottom surfaces 182, 184 of the shank 106 may include one or more elongate ribs 188 extending generally along the longitudinal direction (i.e., along the longitudinal axis $A_{10}$). Each of the ribs 188 may extend along a contoured path corresponding to a profile of the outer periphery 186 along the lateral and medial sides of the shank 106. The ribs 188 provide the shank 106 with localized areas of increased thickness to provide longitudinal stiffness to the shank 106, as desired.

Referring still to FIG. 2, the cradle 108 of the sole structure 100 includes a top surface 190 that faces and attaches to the bottom surface 184 of the shank 106, and a bottom surface 192 formed on an opposite side of the cradle 108 than the top surface 190. The bottom surface 192 forms a portion of the ground-engaging surface of the sole structure 100 between bottom surface 116*a* of the forefoot plate 114*a* and bottom surface 116*b* of the heel plate 114*b*. The cradle 108 is configured to envelope the shank 106 in the mid-foot region 14.

The sole structure 100 of the present disclosure provides several benefits over sole structures known in the art. For example, by providing the annular cleat set 124 and the plurality of radial cleat sets 126*a*-126*e* arranged relative to the central axis $A_{124}$, the sole structure 100 advantageously provides desirable traction in the lateral and longitudinal directions, while allowing the sole structure 100 to rotate about the central axis $A_{124}$ when engaged with a ground surface. Additionally, the inclusion of the peripheral cleats 122*a*-122*d* along the lateral side 22 of the sole structure 100 provides improved traction to the sole structure 100 when the medial side 24 of the sole structure is lifted from the ground surface, such as when pushing off of the lateral side of the foot.

Additional benefits of the sole structure 100 include forming the outsole 102 and the midsole 104 as composite structures. For example, by utilizing outer shells 162*a*, 162*b* and inner skeletons 160*a*, 160*b* for forming the outsole plates 114*a*, 114*b*, an exterior of the outsole 102 can be formed with a more rigid material while the interior of the outsole 102 may be more flexible or provide improved cushioning. Likewise, forming the midsole 104 as a composite structure may allow the exterior of the midsole 104 to be formed of a more durable material while the interior of the midsole 104 is formed with properties to impart desirable stiffness and/or cushioning.

The following Clauses provide exemplary configurations for an article of footwear in accordance with the principles of the present disclosure.

Clause 1: An outsole for an article of footwear, the outsole having a plantar surface and a peripheral surface surrounding the plantar surface and comprising an annular cleat set including a first plurality of traction elements arranged in series about a central axis on the plantar surface and one or more radial cleat sets each including a second plurality of the traction elements aligned along a respective radial axis intersecting the central axis, at least one of the second plurality of the traction elements including a peripheral cleat formed on the peripheral surface.

Clause 2: The outsole of Clause 1, wherein the annular cleat set is disposed on a medial side of the outsole.

Clause 3: The outsole of Clause 1, wherein the annular cleat set is disposed in a forefoot region of the outsole.

Clause 4: The outsole of Clause 1, wherein the annular cleat set is disposed in a ball portion of the outsole.

Clause 5: The outsole of Clause 1, wherein the first plurality of traction elements includes a plurality of major cleats and a plurality of minor cleats.

Clause 6: The outsole of Clause 5, wherein the plurality of major cleats is arranged in a first ring about the central axis and the plurality of minor cleats is arranged in a second ring about the central axis.

Clause 7: The outsole of Clause 6, wherein the first ring has a larger diameter than the second ring.

Clause 8: The outsole of Clause 5, wherein the major cleats have a greater height than the minor cleats.

Clause 9: The outsole of Clause 5, wherein one or more of the major cleats includes a reinforcing rib extending toward the central axis.

Clause 10: The outsole of Clause 5, wherein a width of each of the major cleats and each of the minor cleats tapers.

Clause 11: The outsole of Clause 1, wherein the one or more radial cleat sets includes one or more lateral radial cleat sets disposed adjacent to a lateral side of the outsole.

Clause 12: The outsole of Clause 11, wherein the one or more lateral radial cleat sets is disposed in a forefoot region of the outsole.

Clause 13: The outsole of Clause 11, wherein the one or more lateral radial cleat sets includes a first lateral radial cleat set disposed in ball portion of the outsole and a second lateral radial cleat set disposed in a toe portion of the outsole.

Clause 14: The outsole of Clause 11, wherein the second plurality of the traction elements of each of the one or more lateral radial cleat sets further includes a plurality of minor cleats disposed on the plantar surface, and a major cleat disposed on the plantar surface between the peripheral cleat and the plurality of minor cleats.

Clause 15: The outsole of Clause 14, wherein the major cleat has a greater height than each of the minor cleats.

Clause 16: The outsole of Clause 14, wherein the plurality of minor cleats decrease in size along a direction from the major cleat to the central axis.

Clause 17: The outsole of Clause 14, wherein the peripheral cleat extends at an oblique angle relative to the major cleat.

Clause 18: The outsole of Clause 1, wherein the one or more radial cleat sets includes an anterior radial cleat set disposed at an anterior end of the outsole.

Clause 19: The outsole of Clause 18, wherein the anterior radial cleat set is disposed on a medial side of the outsole.

Clause 20: The outsole of Clause 19, wherein the second plurality of the traction elements of the anterior radial cleat set includes a major cleat disposed on the plantar surface adjacent to the peripheral surface, and a plurality of minor cleats disposed between the major cleat and the central axis.

Clause 21: The outsole of Clause 1, further comprising a heel cleat set disposed in a heel region of the outsole and including a third plurality of the traction elements.

Clause 22: The outsole of Clause 21, wherein the heel cleat set includes a plurality of major cleats and a plurality of minor cleats, the major cleats having a greater height than the minor cleats.

Clause 23: The outsole of Clause 21, wherein the outsole includes a first plate having the annular cleat set and the one or more radial cleat sets, and a second plate having the heel cleat set.

Clause 24: The outsole of Clause 23, wherein at least one of the first plate and the second plate is a modular structure including a shell formed of a first material and a skeleton received within the shell and formed of a second material.

Clause 25: The outsole of Clause 24, wherein the skeleton forms a first portion of one of the traction elements and the shell forms a second portion of the one of the traction elements.

Clause 26: The outsole of Clause 25, wherein the one of the first plate and the second plate further includes an insert forming a third portion of the one of the traction elements.

Clause 27: The outsole of Clause 1, further comprising a major cleat disposed on the plantar surface between the annular cleat set and one of the one or more radial cleat sets.

Clause 28: The outsole of Clause 27, wherein the major cleat is disposed on a medial side of the outsole.

Clause 29: A sole structure including the outsole of Clause 1.

Clause 30: An article of footwear including the outsole of Clause 1.

Clause 31: A sole structure for an article of footwear, the sole structure including a midsole having a top surface and a bottom surface formed on an opposite side than the top surface and an outsole attached to the bottom surface of the midsole and including an annular cleat set including a first plurality of traction elements arranged in series about a central axis on a plantar surface of the outsole, and one or more radial cleat sets each including a second plurality of the traction elements aligned along a respective radial axis intersecting the central axis, at least one of the second plurality of the traction elements including a peripheral cleat formed on a peripheral surface of the outsole.

Clause 32: The sole structure of Clause 31, wherein the second plurality of the traction elements further includes a plurality of minor cleats disposed on the plantar surface, and a major cleat disposed on the plantar surface between the peripheral cleat and the plurality of minor cleats.

Clause 33: The sole structure of Clause 31, wherein the outsole includes a forefoot plate attached to the bottom surface of the midsole in a forefoot region and including the annular cleat set and the one or more radial cleat sets, and a heel plate attached to the bottom surface of the midsole in a heel region.

Clause 34: The sole structure of Clause 33, wherein at least one of the forefoot plate and the heel plate is formed as a modular component.

Clause 35: The sole structure of Clause 33, further comprising a shank attached to the bottom surface of the midsole and disposed between the forefoot plate and the heel plate.

Clause 36: The sole structure of Clause 35, further comprising a cradle attached to the shank and disposed between the forefoot plate and the heel plate.

Clause 37: The sole structure of Clause 31, wherein the midsole includes a casing formed of a first material and a core formed of a second material disposed within the casing.

Clause 38: The sole structure of Clause 37, wherein the core extends from a forefoot region to a heel region.

Clause 39: The sole structure of Clause 37, wherein the midsole includes a recess formed in a top surface of the midsole, the core disposed within the recess.

Clause 40: An article of footwear including the sole structure of Clause 31.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

The invention claimed is:

1. An outsole for an article of footwear, the outsole having a plantar surface and a peripheral surface surrounding the plantar surface and comprising:

an annular cleat set including a first plurality of traction elements arranged in series about a central axis on the plantar surface, the first plurality of traction elements including a plurality of major cleats and a plurality of minor cleats, the plurality of major cleats arranged in a first ring about the central axis and the plurality of minor cleats arranged in a second ring about the central axis, wherein the first ring has a larger diameter than the second ring, and wherein the major cleats have a greater height than the minor cleats, and one or more of the plurality of major cleats includes a reinforcing rib extending toward the central axis; and one or more radial cleat sets each including a second plurality of the traction elements aligned along a respective radial axis intersecting the central axis, at least one of the second plurality of the traction elements including a peripheral cleat formed on the peripheral surface, wherein a given radial cleat set of the one or more radial cleat sets is arranged such that, within the given radial cleat set, a dimension progressively decreases from one radial cleat to a next radial cleat, moving along the respective radial axis from the peripheral cleat toward the annular cleat set.

2. The outsole of claim 1, wherein the annular cleat set is disposed on a medial side of the outsole.

3. The outsole of claim 1, wherein the annular cleat set is disposed in a forefoot region of the outsole.

4. The outsole of claim 1, wherein the annular cleat set is disposed in a ball portion of the outsole.

5. The outsole of claim 1, wherein a width of each of the major cleats and each of the minor cleats tapers.

6. A sole structure for an article of footwear, the sole structure including:

a midsole having a top surface and a bottom surface formed on an opposite side than the top surface; and an outsole attached to the bottom surface of the midsole, the outsole further including:

an annular cleat set including a first plurality of traction elements arranged in series about a central axis on a plantar surface of the outsole, the first plurality of traction elements including a plurality of major cleats and a plurality of minor cleats, wherein the plurality of major cleats are arranged in a first interrupted ring extending around the central axis and the plurality of minor cleats are arranged in a second interrupted ring extending around the central axis; and one or more radial cleat sets each including a second plurality of the traction elements aligned along a respective radial axis intersecting the central axis, at least one of the second plurality of the traction elements including a peripheral cleat formed on a peripheral surface of the outsole, and wherein at least one of the second plurality of the traction elements includes a plurality of major cleats and a plurality of minor cleats, each of the plurality of minor cleats including a dimension that progressively decreases along the respective radial axis from the plurality of major cleats toward the annular cleat set, and wherein the minor cleats taper inward from a first end to a second end in a clockwise direction of the second ring.

7. The sole structure of claim 6, wherein the second plurality of the traction elements further includes a plurality of minor cleats disposed on the plantar surface, and a major cleat disposed on the plantar surface between the peripheral cleat and the plurality of minor cleats.

8. The sole structure of claim 6, wherein the outsole includes a forefoot plate attached to the bottom surface of the midsole in a forefoot region and including the annular cleat set and the one or more radial cleat sets, and a heel plate attached to the bottom surface of the midsole in a heel region.

9. The sole structure of claim 8, further comprising:

a shank attached to the bottom surface of the midsole and disposed between the forefoot plate and the heel plate; and a cradle attached to the shank and disposed between the forefoot plate and the heel plate.

10. The sole structure of claim 6, wherein the midsole includes a casing formed of a first material and a core formed of a second material disposed within the casing, the core extending from a forefoot region to a heel region, and wherein the midsole includes a recess formed in a top surface of the midsole, the core disposed within the recess.

11. An article of footwear including the sole structure of claim 6.

12. The outsole of claim 1, wherein the minor cleats taper inward from a first end to a second end in a clockwise direction of the second ring.

13. An article of footwear including the outsole of claim 1.

14. A sole structure for an article of footwear, the sole structure including:

a midsole having a top surface and a bottom surface formed on an opposite side than the top surface; and an outsole attached to the bottom surface of the midsole, the outsole further including:

an annular cleat set including a first plurality of major cleats arranged in series in a first ring about a central axis on a plantar surface of the outsole and a first plurality of minor cleats arranged in series in a second ring about the central axis on the plantar surface of the outsole, the minor cleats tapering inward from a first end to a second end in a clockwise direction of the second ring; and one or more radial cleat sets each including a second plurality of major cleats, a second plurality of minor cleats, and a peripheral cleat, each of the second plurality of major cleats, the second plurality of minor cleats, and the peripheral cleat, of a given radial cleat set, are aligned along a respective radial axis intersecting the central axis, wherein each of the second plurality of major cleats includes an inner surface and each of the second plurality of minor cleats includes an outer surface, the inner surface of the second plurality of major cleats connected to the outer surface of the second plurality of minor cleats by a reinforcing rib.

15. The sole structure of claim 14, wherein the one or more radial cleat sets includes a plurality of lateral radial cleat sets, an anterior radial cleat set, and a medial major cleat, wherein the medial major cleat is disposed between the anterior radial cleat set and the annular cleat set, and wherein a diameter of the second ring is less than a diameter of the first ring, and wherein the second ring is concentric with and surrounded by the first ring.

16. The sole structure of claim 14, wherein the outsole further includes:

a heel cleat set including a third plurality of major cleats, each of the major cleats of the third plurality of major cleats including a reinforcing rib.

17. An article of footwear including the sole structure of claim 14.

* * * * *